US007052317B2

(12) United States Patent
Hara et al.

(10) Patent No.: US 7,052,317 B2
(45) Date of Patent: May 30, 2006

(54) CONNECTOR CAPABLE OF BEING FIRMLY FIXED TO AN OBJECT AND A FIXING MEMBER USED IN THE CONNECTOR

(75) Inventors: Seiichi Hara, Tokyo (JP); Tadashi Ishiwa, Tokyo (JP); Yasufumi Hayashi, Tokyo (JP)

(73) Assignee: Japan Aviation Electronics Industry, Limited, Tokyo (JP)

( * ) Notice: Subject to any disclaimer, the term of this patent is extended or adjusted under 35 U.S.C. 154(b) by 0 days.

(21) Appl. No.: 11/092,536

(22) Filed: Mar. 29, 2005

(65) Prior Publication Data

US 2005/0221668 A1 Oct. 6, 2005

(30) Foreign Application Priority Data

Mar. 30, 2004 (JP) ..... 2004-100384

(51) Int. Cl.
*H01R 13/60* (2006.01)

(52) U.S. Cl. ..... 439/567; 439/571

(58) Field of Classification Search ..... 439/567, 439/571, 570

See application file for complete search history.

(56) References Cited

U.S. PATENT DOCUMENTS 4,681,389 A * 7/1987 Nakazawa et al. ..... 439/567
5,334,049 A * 8/1994 Kachlic et al. ..... 439/567
5,632,649 A * 5/1997 Spangler ..... 439/567
5,971,803 A * 10/1999 McHugh et al. ..... 439/567
6,030,249 A * 2/2000 Illg ..... 439/570
6,471,544 B1 10/2002 Huang ..... 439/567
2002/0081900 A1 6/2002 Yu et al. ..... 439/567

FOREIGN PATENT DOCUMENTS

JP 9283223 10/1997
JP 11067374 3/1999
JP 3065115 U 10/1999
JP 2001-060469 3/2001
JP 2003-189536 7/2003

OTHER PUBLICATIONS

European Search Report.

* cited by examiner

*Primary Examiner*—Briggitte R. Hammond
(74) *Attorney, Agent, or Firm*—Collard & Roe, P.C.

(57) ABSTRACT

In a connector including an insulator and a contact held by the insulator, a fixing member is coupled to the insulator for fixing the insulator to an object. The fixing member includes a main body received in a receiving portion formed to the insulator. A leg mechanism extends from the main body for being fixed to the object. In addition, a first engaging mechanism extends from the main body and is engaged with the receiving portion in a first direction. On the other hand, the second engaging mechanism extends from the main body and is engaged with the insulator in a second direction opposite to the first direction.

6 Claims, 5 Drawing Sheets

CONNECTOR CAPABLE OF BEING FIRMLY FIXED TO AN OBJECT AND A FIXING MEMBER USED IN THE CONNECTOR

This application claims priority to prior Japanese patent application JP 2004-100384, the disclosure of which is incorporated herein by reference.

BACKGROUND OF THE INVENTION

This invention relates to a connector to be fixed to a board or substrate and a fixing member for fixing the connector to the board.

For example, Japanese Unexamined Patent Application Publication (JP-A) No. H9-283223 discloses an electrical connector. The electrical connector comprises a contact, an insulator holding the contact, a metal shell covering the insulator, and a lock pin as a fixing member. The lock pin is press-fitted into an engaging groove of the insulator by the use of a jig or tool. In order to press-fit the lock pin, the engaging groove is slightly smaller in size than the lock pin. With the above-mentioned structure, if the connector is carelessly attached to a printed board or if the connector is improperly attached, the lock pin may be undesiredly released.

Japanese Unexamined Patent Application Publication (JP-A) No. H11-67374 discloses another electrical connector. The electrical connector comprises a contact, an insulator holding the contact, and a metal fixture as a fixing member. The metal fixture has a press-fit portion fixed to the insulator, a fixing leg to be fixed to a board, and a connecting portion connecting the press-fit portion and the fixing leg. With the above-mentioned structure, a sufficient bearing force against an external force is difficult to obtain because the press-fit portion and the fixing leg of the metal fixture are separated from each other.

SUMMARY OF THE INVENTION

It is therefore an object of this invention to provide a connector which can be firmly fixed to an object so that a soldering portion of a contact is hardly subjected to a stress during a mounting operation and during use.

It is another object of this invention to provide a fixing member for fixing the above-mentioned connector to a board.

Other objects of the present invention will become clear as the description proceeds.

According to a first aspect of the present invention, there is provided a connector comprising an insulator having a receiving portion, a contact held by the insulator, and a fixing member coupled to the insulator for fixing the insulator to an object. The fixing member includes a main body received in the receiving portion, a leg mechanism extending from the main body for being fixed to the object, a first engaging mechanism extending from the main body and engaged with the receiving portion in a first direction, and a second engaging mechanism extending from the main body and engaged with the insulator in a second direction opposite to the first direction.

According to a second aspect of the present invention, there is provided a fixing member for fixing a connector to an object, wherein the fixing member has a flat shape and includes a main body, a leg mechanism extending from the main body for being fixed to the object, a first engaging mechanism extending from the main body and engaged with the connector in a first direction, and a second engaging mechanism extending from the main body and engaged with the connector in a second direction opposite to the first direction.

DESCRIPTION OF THE PREFERRED EMBODIMENTS

Figure 1A:
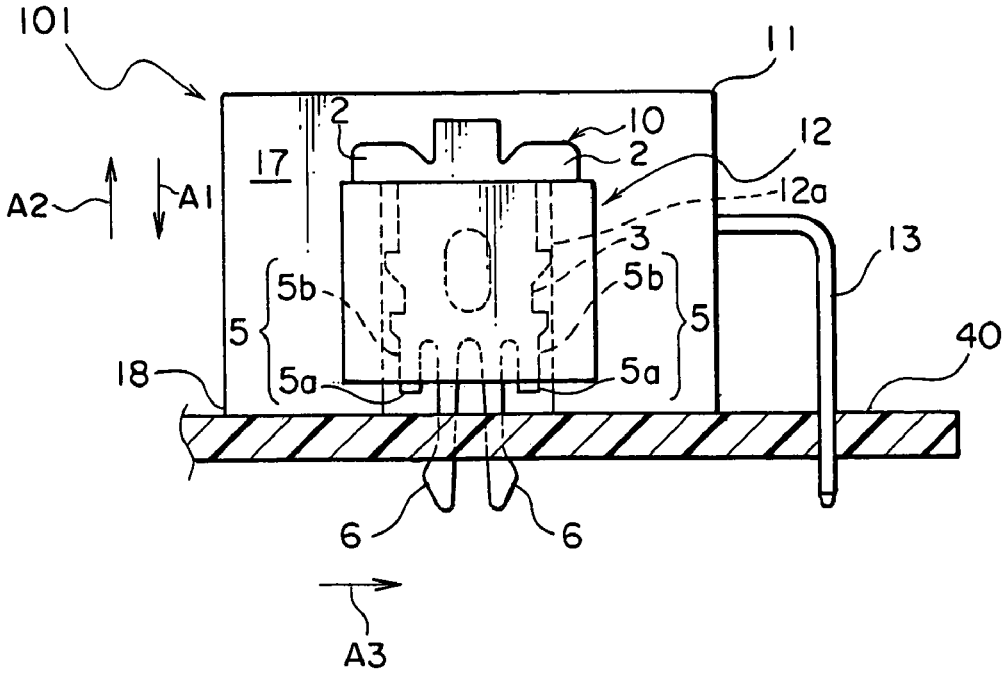
FIGS. 1A and 1B are a front view and a side view of a connector according to an embodiment of this invention, respectively, where the connector is fixed to a board.
Figure 1B:
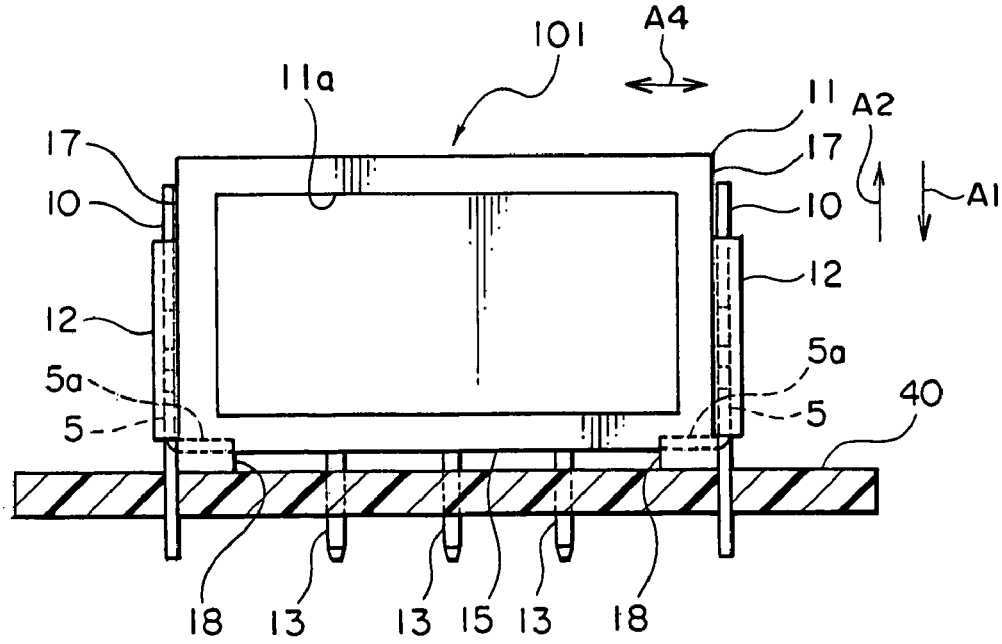

Referring to FIGS. 1A and 1B, description will be made of a connector according to a first embodiment of this invention.

In FIGS. 1A and 1B, the connector is depicted at 101. The connector 101 is mounted on a board 40 in a first direction A1 and is fixed to the board 40 by soldering. The connector 101 can be removed form the board 40 in a second direction A2 opposite to the first direction A2.

The connector 101 comprises a box-shaped insulator 11 and a pair of receiving portions 12 formed on front and rear surfaces 17 of the insulator 11, respectively. The insulator 11 has a fitting portion 11*a* formed on one of its side surfaces to receive a mating connector in a third direction A3 perpendicular to the first and the second directions A1 and A2. The mating connector can be removed from the fitting portion 11*a* in a direction opposite to the third direction A3.

The receiving portions 12 protrude from the front and the rear surfaces 17 of the insulator 11. The insulator 11 has a bottom surface 15 provided with supporting portions 18 formed at its four corners to be brought into contact with the board 40.

A plurality of conductive contacts 13 are held by the insulator 11. The contacts 13 are extracted from another of the side surfaces of the connector 101 and arranged in a fourth direction A4 perpendicular to the first and the third direction A1 and A3. Each of the contacts 13 is bent in an L-shape and extends downward to pass through a through hole formed on the board 40. The contact 13 is fixed at the through hole by a solder (not shown).

Each of the receiving portions 12 is hollow to define a hole or slit 12*a* penetrating in a vertical direction of the connector 101, i.e., in the first and the second directions A1 and A2. A fixing member 10 is inserted in the slit 12*a* in the first direction A1. The slit 12*a* is opened at its upper end and may be partly closed or sealed at its lower end so as to leave openings allowing passage of fixing spring portions 6 and folding tabs 5 which will later be described. A combination of the connector 101 and the fixing member 10 may also be called hereunder a connector.

Figure 2:
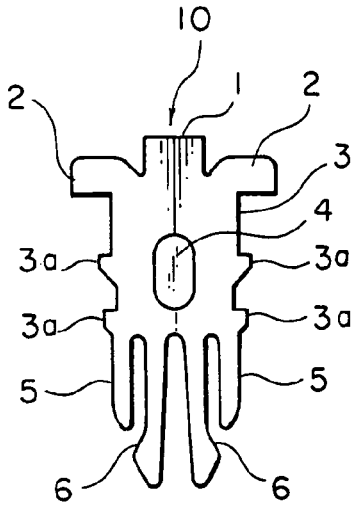
FIG. 2 is a front view of a fixing member included in the connector illustrated in FIGS. 1A and 1B.

Referring to FIG. 2 together with FIGS. 1A and 1B, the description will be directed to the fixing member 10.

The fixing member 10 is formed by punching a metal plate material to have a generally T shape. The fixing member 10 has an integral structure including a head portion 1, a pair of contacting portions or stoppers 2, a main body 3 with press-fitting protrusions 3*a*, a pair of leg portions or fixing spring portions 6, and a pair of branch portions or folding tabs 5. The head portion 1 is formed as a protrusion at an uppermost portion of the main body 3. The stoppers 2 extend leftward and rightward from the main body 7 and are in contact with an upper surface of the receiving portions 12, respectively. The press-fitting protrusions 3*a* protrude leftward and rightward from the main body 3, respectively. Each of the press-fitting protrusions 3*a* is of a wedge-like shape.

A positioning dowel 4 is formed on the main body 3 between the protrusions 3*a*. The positioning dowel 4 protrudes from a plate surface of the main body 3 in a thickness direction to properly position the fixing member 10 within the slit 12*a* in the thickness direction. The fixing spring portions 6 extend downward to be fixed to the board 40.

The folding tabs 5 are branched from the fixing spring portions 6 to extend downward on opposite sides of the fixing spring portions 6. In other words, the folding tabs 5 extend from the main body 3 downward in parallel to the fixing spring portions 6. The fixing spring portions 6 have end portions protruding outward in a widthwise direction in a triangular shape. The fixing spring portions 6 have a gap therebetween which is slightly increased downward. Each of the fixing spring portions 6 has elasticity. The folding tabs 5 serve to prevent the fixing member 10 from being released upward as will later be described.

The fixing member 10 is press-fitted into the slit 12*a* of the receiving portion 12 formed on each of the opposite side surfaces of the insulator 11 of the connector 101. The fixing member 10 is prevented from being moved downward when lower surfaces of the press-fit stoppers 2 are brought into contact with left and right edges of the slit 12*a*. Further, the fixing member 10 is positioned by the positioning dowel 4 in the thickness direction. Thereafter, the folding tabs 5 are folded rearward and forward, respectively, by a jig or tool (not shown) as depicted by broken lines in FIG. 1B. As a result, each of the folding tabs 5 has an end portion 5*a* engaged with the insulator 11 in the second direction A2 and a support portion 5*b* between the end portion 5*a* and the main body 3. With this structure, the fixing member 10 is held or fixed to the insulator 11 of the connector 101. Thus, the fixing member 10 is prevented from being released upward.

Thereafter, when the connector 101 is mounted to the board 40, the fixing spring portions 6 are press-fitted into holes formed in the board 40, so that the connector 101 is fixed to the board 40. The fixing spring portions 6 have tapered portions at their ends and the gap therebetween is widened downward, i.e., towards their ends. Therefore, a slight error in position of the holes formed in the board 40 can be accommodated. Alternatively, the fixing member 10 is press-fitted into the slit 12*a* of the receiving portion 12 of the insulator 11 and the folding tabs 5 are folded after the connector 101 is mounted. In the fixing member 10, the stoppers 2 serve as a first engaging mechanism for engaging with the receiving portion 12 in the first direction A1. The folding tabs 5 serve as a second engaging mechanism for engaging with the insulator 11 in the second direction A2. The fixing spring portions 6 serves as a leg mechanism for being fixed to the board 40.

Figure 3:
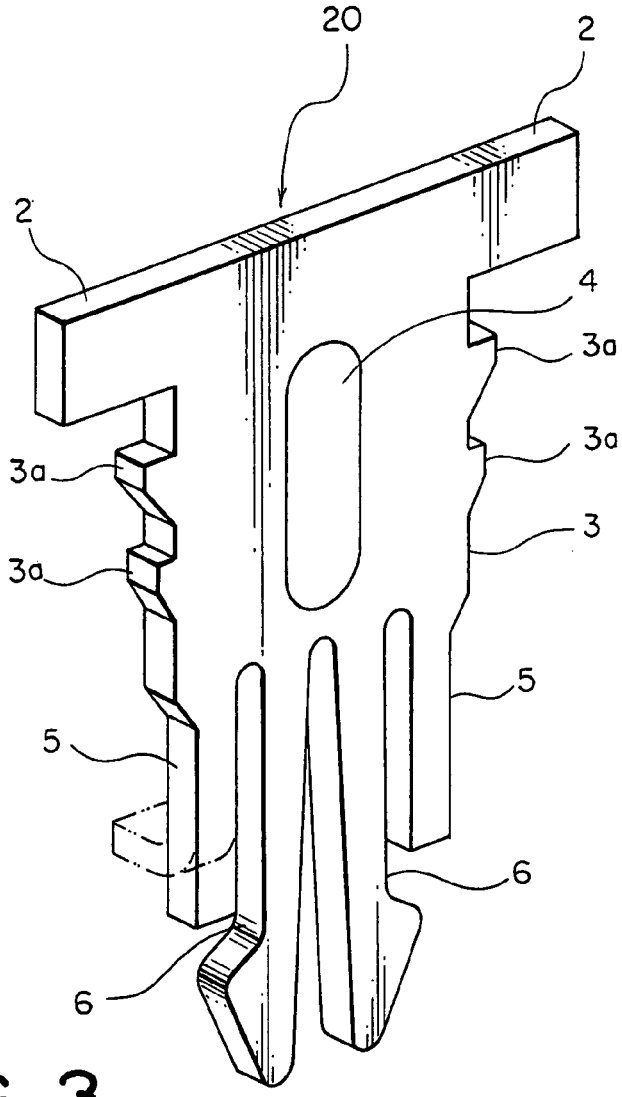
FIG. 3 is a perspective view of a first modification of the fixing member.

Referring to FIG. 3, the description will be made as regards a first modification of the fixing member. The first modification is illustrated as a fixing member 20. Similar parts are designated by like reference numerals and description thereof will be omitted.

In FIG. 3, the fixing member 20 has an upper surface as a flat surface. A part of the upper surface forms an upper surface of each of the stoppers 2. The folding tabs 5 are folded rearward and forward similar to the manner described in conjunction with FIGS. 1A and 1B. As far as the folding tabs 5 can be fixed to the connector, the folding tabs 5 may be folded in a lateral direction.

Figure 4:
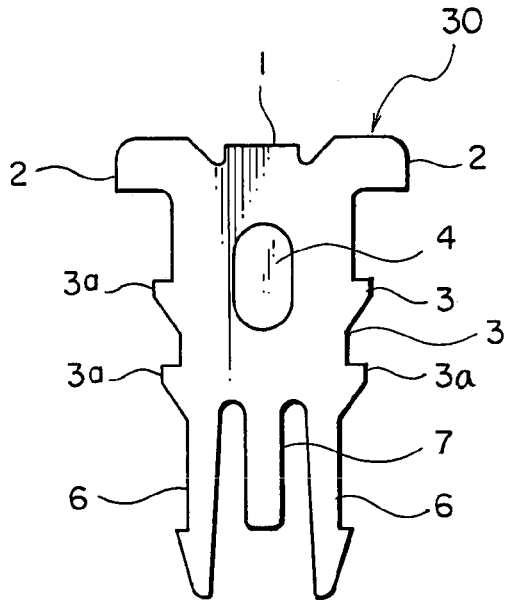
FIG. 4 is a perspective view of a second modification of the fixing member.
Figure 5:
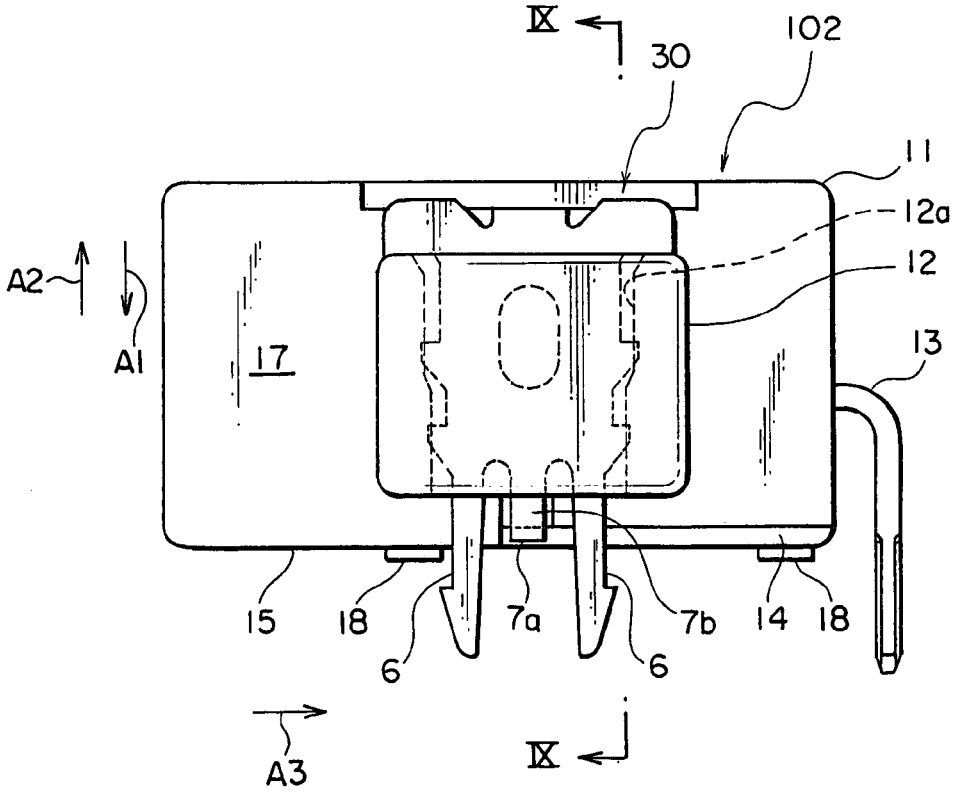
FIG. 5 is a front view of a connector including the fixing member illustrated in FIG. 4.
Figure 6:
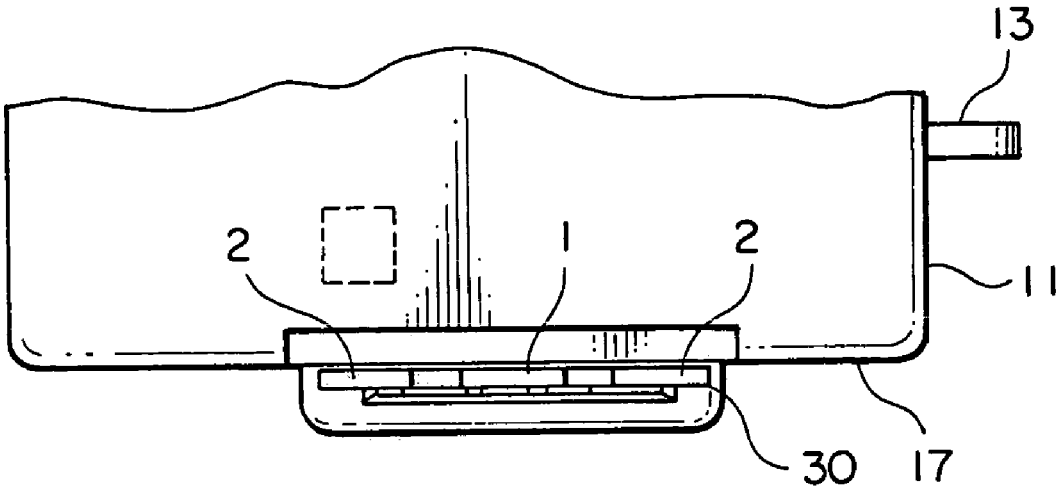
FIG. 6 is a plan view showing a part of the connector illustrated in FIG. 5.

Referring to FIG. 4, the description will be made as regards a second modification of the fixing member. The second modification is illustrated as a fixing member 30. Similar parts are designated by like reference numerals and description thereof will be omitted.

In the fixing member 30 of FIG. 4, the head portion 1 is formed lower than that of the fixing member 10 illustrated in FIG. 2. A single folding tab 7 extends downwardly from the main body 3 between the fixing spring portions 6.

Referring to FIGS. 5 through 9, the description will be made as regards a connector 102 using the fixing member 30 illustrated in FIG. 4. Similar parts are designated by like reference numerals and description thereof will be omitted.

Figure 7:
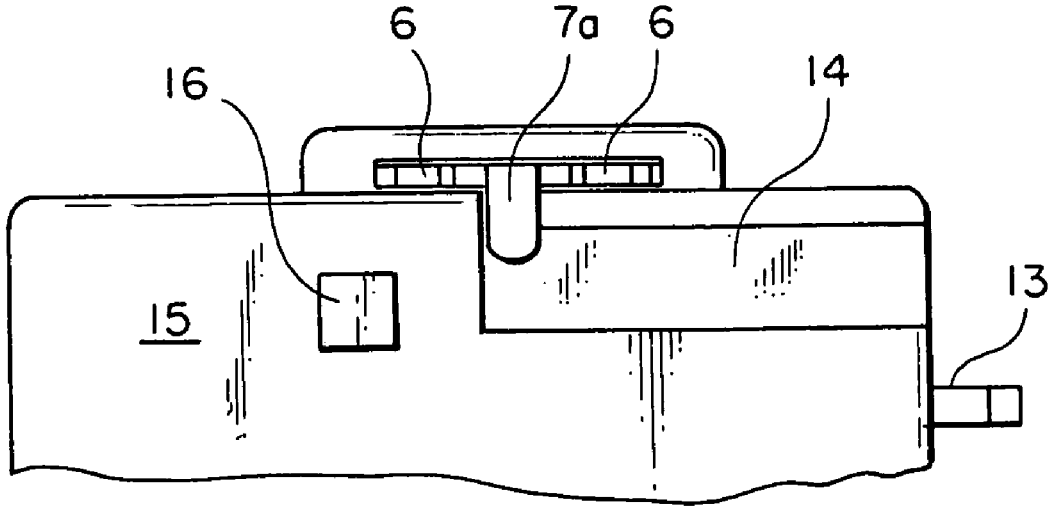
FIG. 7 is a bottom view corresponding to FIG. 6.
Figure 8:
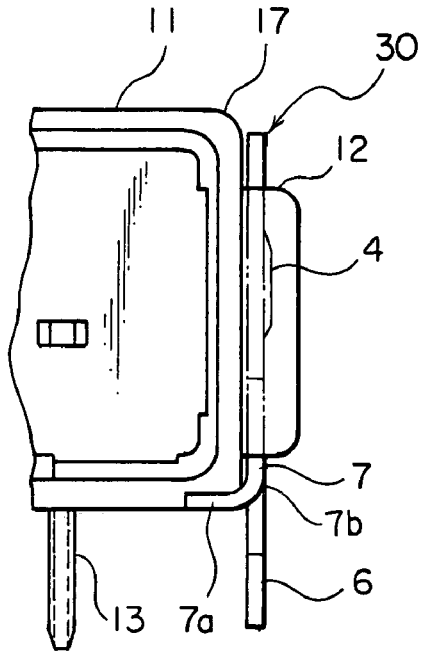
FIG. 8 is a side view of a part of the connector illustrated in FIG. 5.
Figure 9:
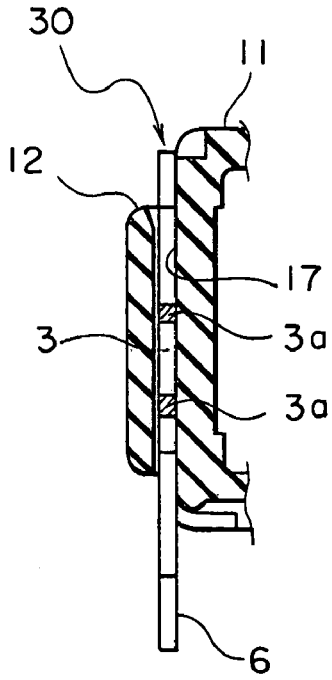
FIG. 9 is a partial sectional view taken along a line IX—IX in FIG. 5.

In the connector 102, the fixing member 30 is press-fitted into the slit 12*a* of the receiving portion 12 formed on each of the front and the rear surfaces of the insulator 11 of the connector 102. The fixing member 30 is positioned by the positioning dowel 4 in the thickness direction of the fixing member 30. Thereafter, the folding tab 7 is folded rearward by a jig or tool (not shown) to have an end portion or folded portion 7*a*. As a result, the folded portion 7*a* is brought in press contact with a recessed portion 14 of the bottom surface 15 of the connector 102 as illustrated in FIGS. 7 through 9. Thus, the fixing member 30 is fixed to the insulator 11 of the connector 102. In this state, a remaining portion 7*b* of the folding tab 7 will be called a support portion. In this event, the folding tab 7 serves as the second engaging mechanism for engaging with the insulator 11 in the second direction A2.

Thereafter, when the connector 102 is mounted to the board, the fixing spring portions 6 are press-fitted into holes formed in the board so that the connector 102 is fixed to the board and is prevented from being released from the board by the hooks at the end portions of the fixing spring portions 6. Alternatively, the fixing member 30 is press-fitted into the slit 12*a* of the receiving portion 12 of the insulator 11 and the folding tab 7 is folded after the connector 102 is mounted.

Each of the above-mentioned fixing members 10, 20, and 30 is inserted into the slit or through hole formed in the receiving portion 12 and extending in the direction perpendicular to the plane of the printed board. The stoppers and the fixing spring portions fixed to the printed board are positioned at upper and lower positions with respect to the plane of the printed board. The fixing member is fixed by folding the folding tab for preventing release from the insulator 11. With the above-mentioned structure, a sufficient strength is assured against an external force.

Therefore, in the connector to be mounted to the printed board, the insulator can be firmly fixed to the printed board so that a soldering portion of the contact is hardly subjected to a stress during mounting to the printed board and during use.

The fixing member is press-fitted and fixed to the insulator in the direction perpendicular to the plane of the printed board. Therefore, a large bearing force is exerted against an external force, particularly, in a direction of peeling off the connector from the printed board. Thus, the above-mentioned fixing member is suitable for use in the connector to be mounted and fixed to the board.

What is claimed is:

1. A connector comprising:

an insulator having a receiving portion;

a contact held by the insulator; and a fixing member coupled to the insulator for fixing the insulator to an object, the fixing member including:

a main body received in the receiving portion;

a leg mechanism extending from the main body for being fixed to the object;

a first engaging mechanism extending from the main body and engaged with the receiving portion in a first direction; and a second engaging mechanism extending from the main body and engaged with the insulator in a second direction opposite to the first direction, the second engaging mechanism including a pair of branch portions extending parallel to each other, each of the branch portions having an end portion which extends in a third direction perpendicular to the first direction and which is engaged with the insulator in the second direction, the insulator having a side wall on which the receiving portion is formed, the branch portions further having support portions, respectively, each extending from the main body towards the first direction, and the end portion being bent substantially perpendicular to the support portions.

2. The connector according to claim 1, wherein the leg mechanism has a pair of leg portions which is placed between the support portions and extends from the main body in the first direction.

3. The connector according to claim 1, wherein the receiving portion has a through hole extending in the first direction, the main body having a particular portion press-fitted in the through hole.

4. A fixing member for fixing a connector to an object, wherein the fixing member has a flat shape and includes:

a main body;

a leg mechanism extending from the main body for being fixed to the object;

a first engaging mechanism extending from the main body and engaged with the connector in the first direction; and a second engaging mechanism extending from the main body and engaged with the connector in a second direction opposite to the first direction, the second engaging mechanism including a pair of branch portions extending parallel to each other, each of the branch portions having an end portion which extends in a third direction perpendicular to the first direction and which is engaged with the connector in the second direction, the branch portions further having support portions, respectively, extending from the main body towards the first direction, the end portion being bent substantially perpendicular to the support portions, and the leg mechanism having a pair of leg portions which is placed between the support portions and extends from the main portion in the first direction.

5. A connector comprising:

an insulator having a receiving portion;

a contact held by the insulator; and a fixing member coupled to the insulator for fixing the insulator to an object, the fixing member including:

a main body received in the receiving portion;

a leg mechanism extending from the main body for being fixed to the object;

a first engaging mechanism extending from the main body and engaged with the receiving portion in a first direction;

a second engaging mechanism extending from the main body and engaged with the insulator in a second direction opposite to the first direction, the leg mechanism having a pair of leg portions extending from the main body in the first direction, the second engaging mechanism having a support portion which is placed between the leg portions and extends from the main body in the first direction.

6. A fixing member for fixing a connector to an object, wherein the fixing member has a flat shape and includes:

a main body;

a leg mechanism extending from the main body for being fixed to the object;

a first engaging mechanism extending from the main body and engaged with the connector in the first direction; and a second engaging mechanism extending from the main body and engaged with the connector in a second direction opposite to the first direction, the leg mechanism having a pair of leg portions extending from the main body in the first direction, the second engaging mechanism having a support portion which is placed between the leg portions and extends from the main body in the first direction.

* * * * *